US008231203B2

(12) United States Patent
Akama et al.

(10) Patent No.: US 8,231,203 B2
(45) Date of Patent: Jul. 31, 2012

(54) INK JET PRINT HEAD, INK JET PRINTING APPARATUS AND INK JET PRINTING METHOD

(75) Inventors: Yuichiro Akama, Tokyo (JP); Keiji Tomizawa, Yokohama (JP); Toru Yamane, Yokohama (JP); Masaki Oikawa, Inagi (JP); Genji Inada, Koshigaya (JP); Mikiya Umeyama, Tokyo (JP); Chiaki Muraoka, Kawaguchi (JP); Tomotsugu Kuroda, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 375 days.

(21) Appl. No.: 12/536,979

(22) Filed: Aug. 6, 2009

(65) Prior Publication Data

US 2010/0045719 A1 Feb. 25, 2010

(30) Foreign Application Priority Data

Aug. 21, 2008 (JP) ..... 2008-213028

(51) Int. Cl.
*B41J 2/21* (2006.01)

(52) U.S. Cl. ..... 347/43

(58) Field of Classification Search ..... 347/43
See application file for complete search history.

(56) References Cited

U.S. PATENT DOCUMENTS

| | | | | |
|---|---|---|---|---|
| 6,976,748 | B2 | 12/2005 | Yabe et al. | |
| 7,410,239 | B2 | 8/2008 | Takahashi et al. | |
| 7,438,374 | B2 | 10/2008 | Shibata et al. | |
| 7,591,537 | B2 | 9/2009 | Tsuchii et al. | |
| 2007/0285450 | A1 * | 12/2007 | Noguchi | 347/12 |
| 2008/0143786 | A1 | 6/2008 | Oikawa et al. | |
| 2008/0252698 | A1 | 10/2008 | Kudo et al. | |
| 2008/0273055 | A1 | 11/2008 | Takahashi et al. | |
| 2009/0147050 | A1 | 6/2009 | Kuroda et al. | |

FOREIGN PATENT DOCUMENTS

| | | | |
|---|---|---|---|
| CN | 1824513 | A | 8/2006 |
| JP | 2004-001491 | | 1/2004 |
| JP | 2006-347155 | A | 12/2006 |
| JP | 2007-331352 | | 12/2007 |

OTHER PUBLICATIONS

Office Action dated Jan. 28, 2010, in counterpart Chinese Application No. 200910167237.8, and English-language translation thereof.

* cited by examiner

*Primary Examiner* — Julian Huffman
(74) *Attorney, Agent, or Firm* — Fitzpatrick, Cella, Harper & Scinto

(57) ABSTRACT

While the print head is reduced in size, the adverse effect of air flows produced by ink droplets as they are ejected from a small number of ejection opening arrays is minimized. A small number of first ejection opening arrays eject one of three primary colors—cyan, magenta and yellow—and a large number of second and third ejection opening arrays eject the remaining two primary colors. A fourth ejection opening array is disposed between the first ejection opening array and the second or third ejection opening array.

11 Claims, 16 Drawing Sheets

INK JET PRINT HEAD, INK JET PRINTING APPARATUS AND INK JET PRINTING METHOD

BACKGROUND OF THE INVENTION

1. Field of the Invention

The present invention relates to an ink jet print head having a plurality of ejection openings to eject yellow, magenta and cyan inks, an ink jet printing apparatus using the print head, and an ink jet printing method.

2. Description of the Related Art

As personal computers, word processors and facsimile machines have come into widespread use in offices and homes in recent years, a variety of types of printing apparatus have been commercialized as information output devices for these apparatus. Of these output devices an ink jet printing apparatus has many advantages, such as the capability to perform color printing relatively easily using a plurality of color inks, low printing noise, the capability to print on a variety of print media with high print quality and small printer size. Because of these advantages, an ink jet printing apparatus is suited for office use and for personal use at homes. Of the ink jet printing apparatus, a serial type that reciprocally moves the print head over a print medium for printing is very popular because of its ability to perform high quality, low cost printing.

In a serial type printing apparatus, bidirectional printing may be performed in which a print head mounted on a carriage (and capable of ejecting a plurality of inks) prints an image as the carriage moves forward and backward. In such a printer the order in which colored inks are ejected (the ink ejection order) is reversed for forward and backward movement of the print head. The reversal of the ink ejection order between the forward and backward movements of the carriage may cause bandlike grayscale level variations on a printed image (hereinafter referred to also as a "bidirectional color difference").

A print head described in Japanese Patent Laid-Open No. 2004-001491, for example, has five ink ejection opening arrays, of which one is for yellow ink, two for cyan ink and the remaining two for magenta ink. The yellow ink ejection opening array is situated at the center of the five ejection opening arrays, with one cyan ink ejection opening array and one magenta ink ejection opening array on each side thereof. Two sets of the cyan ink ejection opening array and the magenta ink ejection opening array are arranged symmetrical with respect to the center yellow ink ejection opening array so that the ink ejection orders during the forward and backward movements are the same.

In such a print head, the yellow ink ejection opening array has only those ejection openings that eject large ink droplets while the cyan and magenta ink ejection opening arrays each have ejection openings that eject large and small ink droplets. This arrangement is made because the bright yellow ink hardly shows graininess of an image even if printed with only large ink droplets, whereas the cyan and magenta inks with low brightness levels tend to show graininess in printed areas with low grayscale levels unless the image is printed with small ink droplets. Therefore, small yellow ink droplets are not necessary to reduce graininess. So, only large ink droplet ejection openings are provided for yellow ink.

There has been a growing call for faster printing speeds in recent years and, among methods known to meet that demand, there is one method that reduces the number of scans (scan number). In printing images with the same grayscale levels, a reduction in the number of scans can increase ink ejection density in one scan.

In Japanese Patent Laid-Open No. 2004-001491, a yellow ink ejection opening array has large ink droplet ejection openings arrayed on each side of a corresponding ink supply port. The magenta and cyan ink ejection opening arrays each have large ink droplet ejection openings arrayed on one side of a corresponding ink supply port and small ink droplet ejection openings arrayed on the other side thereof. So, magenta and cyan large ink droplets are ejected from the openings situated on one side of the corresponding ink supply ports while yellow large ink droplets are ejected from openings situated on both sides of the corresponding ink supply port. Therefore, the print head has a high ejection density in a unit area for the large yellow ink droplets and, when an image of high grayscale level is printed, a strong air flow is produced near the yellow ink ejection opening array by the ejection of large yellow ink droplets. This raises a possibility of bandlike color variations being produced when an image of secondary color is printed by ink droplets ejected from the yellow ink ejection opening array and the adjoining magenta or cyan ink ejection opening array. That is, the air flow produced near the former ejection opening array may disturb landing positions of ink droplets ejected from the latter ejection opening array, causing bandlike color variations. Such bandlike color variations are called "air flow-based color variations". Small ink droplets are affected particularly strongly by the air flows.

SUMMARY OF THE INVENTION

The present invention provides an ink jet print head that can be reduced in sized and still minimize the influence of air flows produced by ink droplets ejected from a smaller number of ejection opening arrays. This invention also provides an ink jet printing apparatus and an ink jet printing method to reduce bandlike color variations and thereby enabling the printing of high-quality images.

In the first aspect of the present invention, there is provided an ink jet print head having a plurality of ejection openings formed therein to eject yellow, magenta and cyan inks, the ink jet print head, the ink jet print head comprising: at least one of a first ejection opening array, along which the plurality of ejection openings for ejecting one of the yellow, magenta and cyan inks are arrayed; at least one of a second ejection opening array, along which the plurality of ejection openings for ejecting one of the remaining two inks are arrayed; and at least one of a third ejection opening array, along which the plurality of ejection openings for ejecting the remaining ink are arrayed, wherein the first, second and third ejection opening arrays are parallelly arranged to adjoin each other in a predetermined direction, wherein the number of the first ejection opening arrays is less than those of the second ejection opening arrays and the third ejection opening arrays, and wherein a fourth ejection opening array, along which a plurality of ejection openings for ejecting a fourth ink different from the yellow, magenta and cyan inks are arrayed, the fourth ejection opening array being disposed between the first ejection opening array and the second or third ejection opening array, the first ejection opening array and the second or third ejection opening array being arranged adjoining each other in the predetermined direction.

In the second aspect of the present invention, there is provided an ink jet printing apparatus for printing an image on a print medium by using an ink jet print head, wherein the ink jet print head has at least one of a first ejection opening array, at least one of a second ejection opening array, at least one of a third ejection opening array and at least one of a fourth ejection opening array arranged parallelly to adjoin each other in a predetermined direction, each of the ejection opening arrays having a plurality of ink ejection openings, wherein the number of the first ejection opening arrays is less than those of the second and third ejection opening arrays, wherein the fourth ejection opening array is disposed between the first ejection opening array and the second or third ejection opening array, the first ejection opening array and the second or third ejection opening array being arranged adjoining each other in the predetermined direction, and wherein the ink jet printing apparatus includes a unit that ejects one of yellow, magenta and cyan inks from the first ejection opening array, ejects one of the remaining two inks from the second ejection opening array, ejects the remaining ink from the third ejection opening array, and ejects a fourth ink, different from the yellow, magenta and cyan inks, from the fourth ejection opening array.

In the third aspect of the present invention, there is provided an ink jet printing method for printing an image on a print medium by using an ink jet print head, the method comprising: a providing step of providing the ink jet print head that has at least one of a first ejection opening array, at least one of a second ejection opening array, at least one of a third ejection opening array and at least one of a fourth ejection opening array arranged parallelly to adjoin each other in a predetermined direction, each of the ejection opening arrays having a plurality of ink ejection openings, wherein the number of the first ejection opening arrays is less than those of the second and third ejection opening arrays, wherein the fourth ejection opening array is disposed between the first ejection opening array and the second or third ejection opening array, the first ejection opening array and the second or third ejection opening array being arranged adjoining each other in the predetermined direction; and an ejecting step in which one of yellow, magenta and cyan inks is ejected from the first ejection opening array, one of the remaining two inks is ejected from the second ejection opening array, the remaining ink ejected from the third ejection opening array, and a fourth ink, different from the yellow, magenta and cyan inks, is ejected from the fourth ejection opening array.

According to the present invention, between a smaller number of first ejection opening arrays that eject one of three primary inks—cyan, magenta and yellow—and a greater number of second and third ejection opening arrays that eject the remaining two colors, there is a fourth ejection opening array that ejects a fourth ink different from the three primary inks. This arrangement can minimize the effect that the air flows, produced by the first ejection opening arrays ejecting ink droplets at high density, have on the ink droplets ejected from the second and third ejection opening arrays. As a result, the bandlike color variations can be alleviated, forming high-quality images. Further, since the air flow influences can be reduced without having to especially increase the intervals between a plurality of ejection opening arrays, the print head can be reduced in size.

The fourth ink, whatever it is, may be replaced with the three primary colors—cyan, magenta and yellow. For example, when ink is ejected from the first ejection opening array at a high density, higher than a predetermined level, the fourth ink may be replaced with three primary colors of cyan, magenta and yellow. When the ejection density of ink from the first ejection opening array is low, less than the predetermined level, the fourth ink may be used. As a result, when ink is ejected from the first ejection opening array at high density, the air flow-based color variations of ink ejected from the ejection opening array adjoining the first one can be avoided. Further, the use of the fourth ink can also improve the print quality of an image. Since the cyan, magenta and yellow inks are of the three primary colors, when an image is formed with colors made by mixing inks ejected from the first and fourth ejection opening arrays, it is possible to use the first and fourth ejection opening arrays at an ejection density that will not cause the "air flow-based color variations".

Further features of the present invention will become apparent from the following description of exemplary embodiments (with reference to the attached drawings).

DESCRIPTION OF THE EMBODIMENTS

Now embodiments of this invention will be described by referring to the accompanying drawings.

First Embodiment

Figure 16:
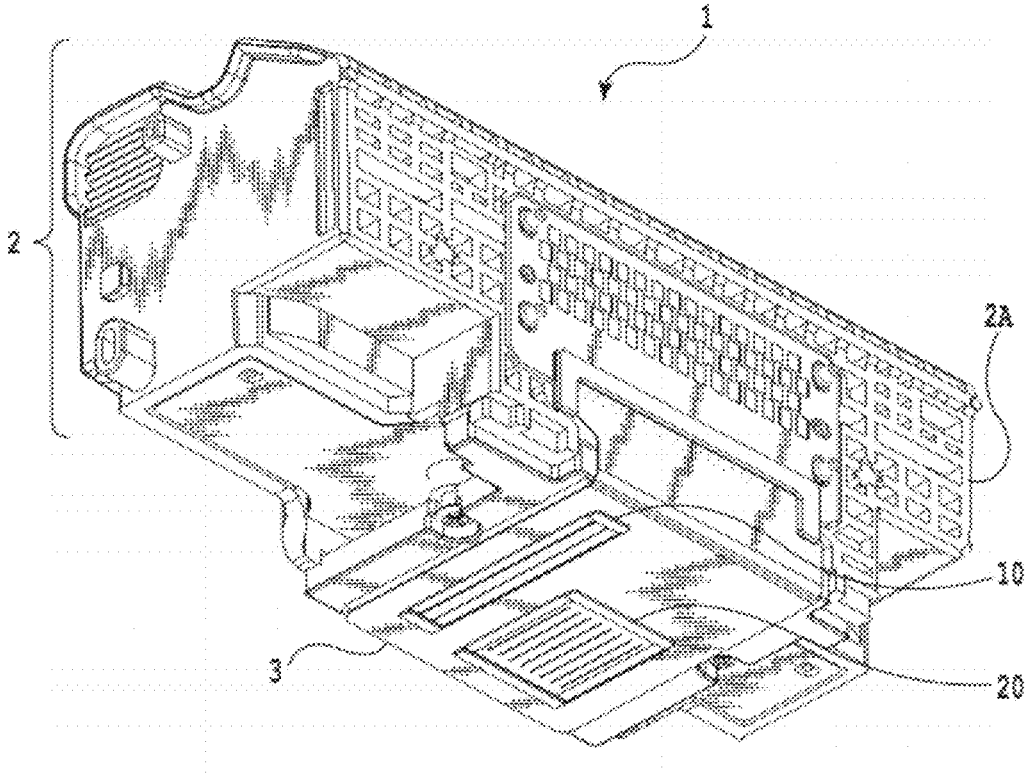
FIG. 16 is a perspective view of the ink jet print head of the first embodiment of this invention.

FIG. 16 is a perspective view of one example of an ink jet print head.

An ink jet print head 1 in this example includes an ink supply portion 2 and an ink ejection portion 3. The ink supply portion 2 has an ink tank holder 2A for holding an ink tank (not shown) and is connected to the ink ejection portion 3 for ink supply. The ink ejection portion 3 has a Bk chip 10 for ejecting pigment black ink and a color chip 20 for ejecting a plurality of dye color inks.

Figure 1:
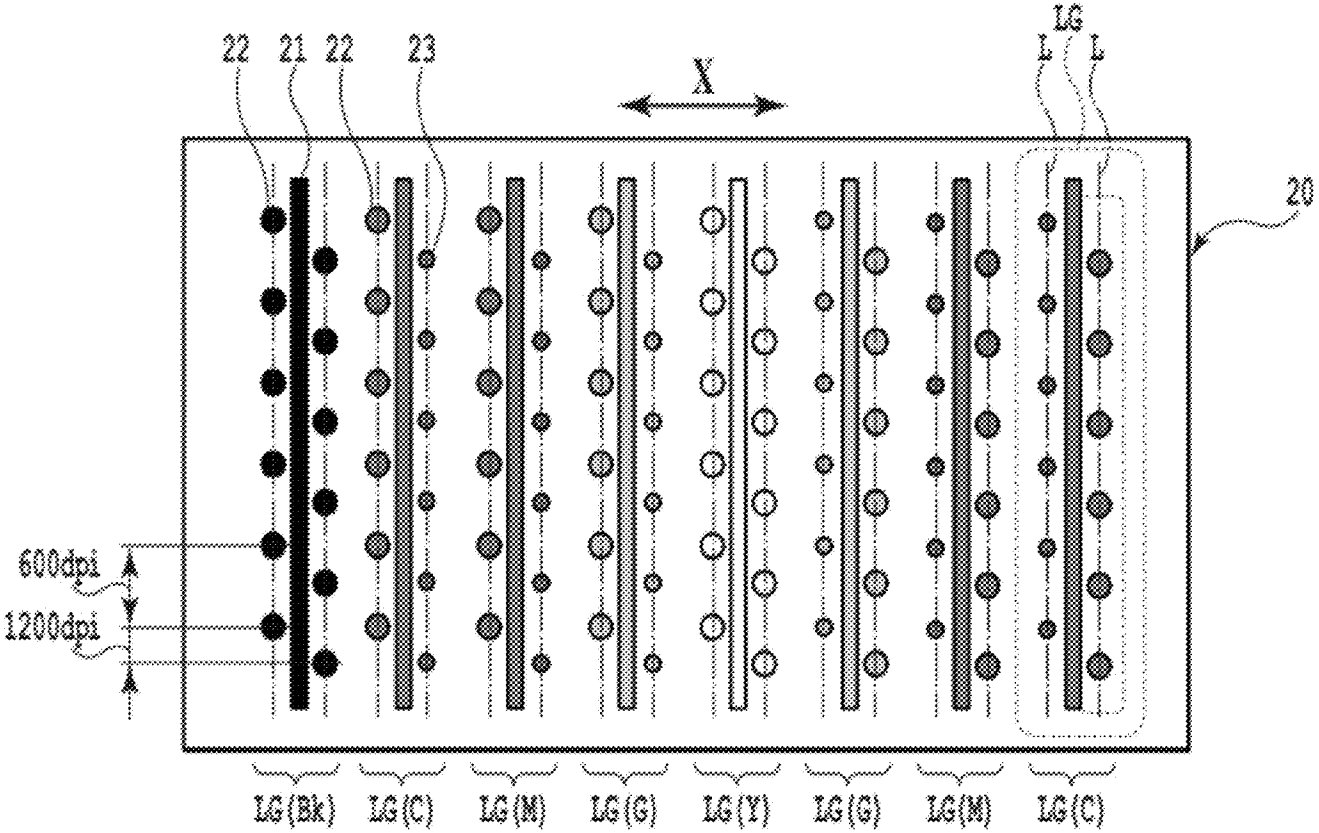
FIG. 1 is an explanatory diagram showing ejection opening arrays in a first embodiment of this invention.

FIG. 1 is an outline construction of the color chip 20 which has a plurality of common liquid chambers 21 connected to the ink supply portion 2. The common liquid chambers 21 are rectangular in shape. On both sides of each of the common liquid chambers 21 there are formed two ejection opening arrays L, one composed of a plurality of ejection openings 22 and the other of a plurality of ejection openings 23. The ejection openings 22, 23 open from a nozzle plate connected to a member in which the common liquid chambers 21 are formed (common liquid chamber forming member). In the common liquid chamber forming member are arranged electrothermal conversion elements (heaters) at positions facing the ejection openings 22, 23.

The heaters, a bubble chamber enclosing the heater, ejection openings 22, 23 (that open on a plane of the bubble chamber facing the heater) and an ink path connecting the bubble chamber and the common liquid chambers 21 combine to form a nozzle (ink jet nozzle).

264 of the ejection openings 22, 23 are arrayed at intervals of 600 dpi (about 42.3 μm) in each of the ejection opening arrays L. In the ejection opening arrays L on both sides of each of the common liquid chambers 21, the ejection openings 22 and the ejection openings 22, or the ejection openings 22 and the ejection openings 23, are arranged so as to be staggered. These ejection opening arrays L on both sides of each common liquid chamber 21 have a total of 528 ejection openings 22 and 22, or 22 and 23, at intervals of 1200 dpi (about 21.2 μm). The total of 528 ejection openings 22 and 22, or 22 and 23, in the ejection opening arrays L on both sides of each common liquid chamber 21, form a group of ejection opening arrays LG. In FIG. 1 each of the ejection opening arrays L is shown to have six ejection openings 22, 23 for convenience sake.

In this embodiment, there are eight of the common liquid chambers 21 and the same number of the ejection opening array groups LG are also formed. Supplied to the eight common liquid chambers 21, from left to right in FIG. 1, are black ink (Bk), cyan ink (C), magenta ink (M), gray ink (G), yellow ink (Y), gray ink (G), magenta ink (M) and cyan ink (C). Only one ejection opening array group LG is provided to the black ink (Bk) and yellow ink (Y) each. Two ejection opening array groups LG are provided to each of the cyan ink (C), magenta ink (M) and gray ink (G). These two sets of ejection opening array groups LG are arranged symmetrical, one on each side, with respect to the yellow ink (Y) common liquid chamber 21, located at the center.

Figure 2B:
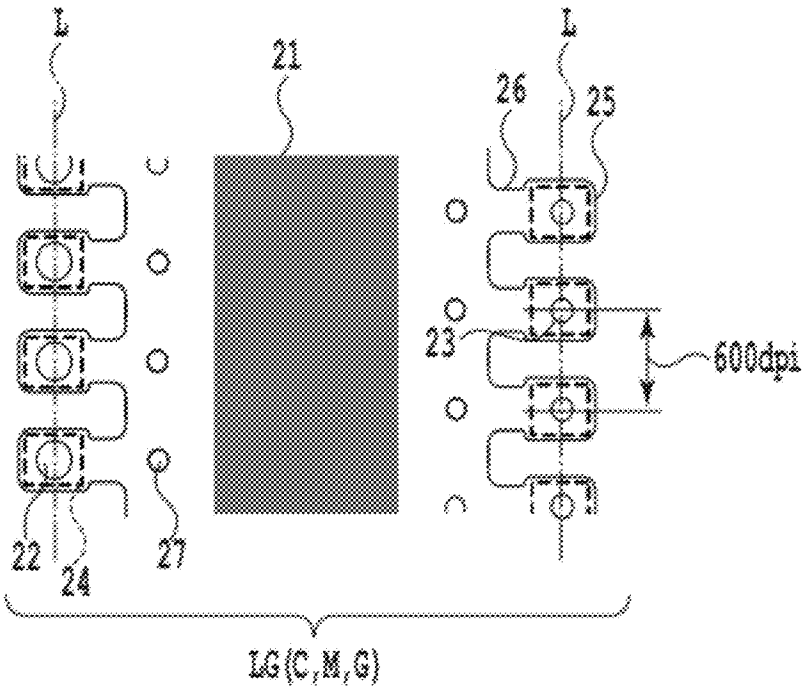
FIG. 2B is an outline configuration diagram showing cyan ink, magenta ink and gray ink ejection opening arrays of FIG. 1.
Figure 2A:
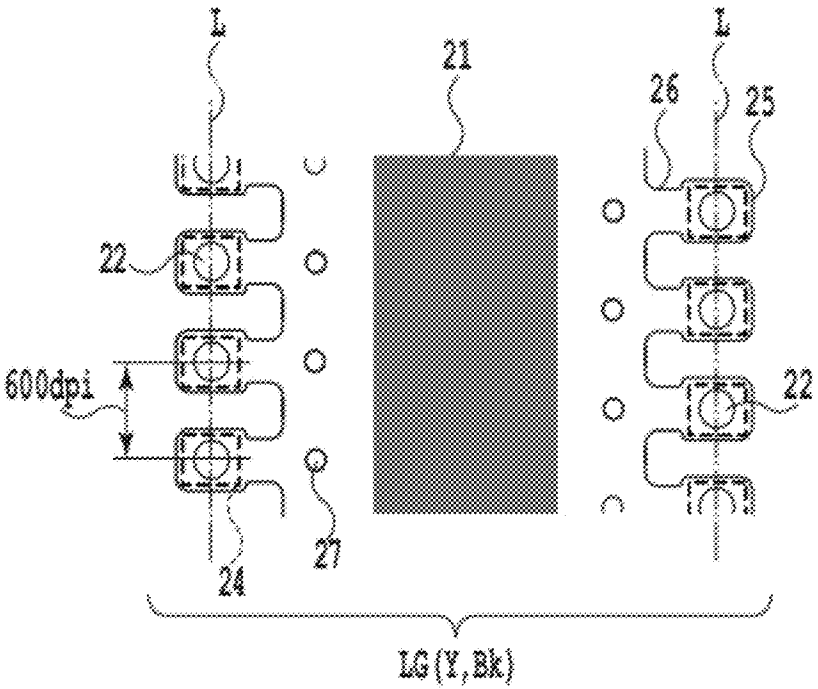
FIG. 2A is an outline configuration diagram showing black ink and yellow ink ejection opening arrays of FIG. 1

FIG. 2A shows the ejection opening array groups LG (Bk, Y) for black ink (Bk) and yellow ink (Y) The ejection openings 22 for black ink and yellow ink are about 16 μm in diameter and eject ink droplets of about 5 pl (large ink droplets). An electrothermal conversion element (heater) 24, a bubble chamber 15 enclosing the heater 24, and an ink path 26 connecting the bubble chamber 25 and the common liquid chamber 21 are also disclosed in FIG. 2A. Pillars 27 for blocking foreign matter in the ink from entering into the ink path 26 (foreign matter blocking pillars) are also illustrated.

FIG. 2B shows ejection opening array groups LG (C, M, G) for cyan ink (C), magenta ink (M) and gray ink (G). Of the two ejection opening arrays L situated on the left and right side of each of the common liquid chambers 21, one ejection opening array L on one side is comprised of ejection openings 22, of about 16 μm in diameter, that eject ink droplets of about 5 pl (large ink droplets), as with the ejection openings 22 for black ink and yellow ink. The other ejection opening array L is comprised of ejection openings 23, of about 12 μm across, that eject ink droplets of about 2 pl (small ink droplets). In each of these ejection opening array groups LG (C, M, G), an ejection opening array L of large ejection openings 22 is arranged on the farther side from the yellow (Y) ejection opening array group LG. On the near side of each of the ejection opening array groups LG (C, M, G) with respect to the yellow (Y) ejection opening array group LG, there is located an ejection opening array L of small ejection openings 23 is placed.

Two gray ink (G) ejection opening array groups LG (G) are arranged one on each side of the yellow ink (Y) ejection opening array group LG (Y) so that they are symmetrical with respect to the ejection opening array group LG (Y). These two ejection opening array groups LG (G) are provided for the following purposes.

(1) To smooth out gradation changes from highlighted areas to halftone areas when printing a monochromatic photograph;
(2) To smooth out gradation changes in gray color areas when a color photograph is printed; and
(3) To print gray areas when printing on plain paper.

As for the black ink (Bk) ejection opening array group LG (Bk), only one is provided for the following purpose so that it is not symmetrical with respect to the central, yellow ink (Y) ejection opening array group LG (Y).

(1) To print a high grayscale level monochromatic image when printing a monochromatic photograph; and
(3) To black some areas when printing a color photograph.

In this embodiment, a dye black ink (Bk) ejected from the color chip 20 is not used for printing on plain paper. For printing on plain paper a pigment black ink ejected from the Bk chip 10 is used.

Next, an ink ejection operation by the ink jet print head 1 will be described. In response to an electric signal from a drive portion (not shown) to the ink ejection portion 3, a drive current is selectively applied to the heater 24 of each nozzle. When each heater 24 is energized, ink near that heater is heated and boiled. A pressure generated by the boiling causes ink to be ejected from the ejection opening 22, 23 facing the heater 24. When all of the heaters 24 are energized at the same time, a large voltage drop will occur. Therefore, in each of the ejection opening arrays L one in every sixteen heaters 24 are grouped together, thus dividing the 264 heaters 24 into sixteen groups. Each group comprises 16 heaters 24. The sixteen groups of heaters 24 are operated on a time-division basis (on a 16-time-division basis) to minimize the voltage drop. A drive frequency for one heater 24 is 15 kHz.

$$16 \text{ heaters} \times 16 \text{ (time-division)} = 256 \text{ heaters}$$

It is noted that the actual number of heaters 24 in one array is 256, not 264, as described above. This is because there are eight dummy heaters (=264−256) not used for printing. The dummy heaters are used to discharge mixed inks at the end of the common liquid chambers 21 from ejection openings when ink mixing occurs in a common liquid chamber 21.

Next, the printer (ink jet printing apparatus) using the ink jet print head 1 of this embodiment will be described.

Figure 3:
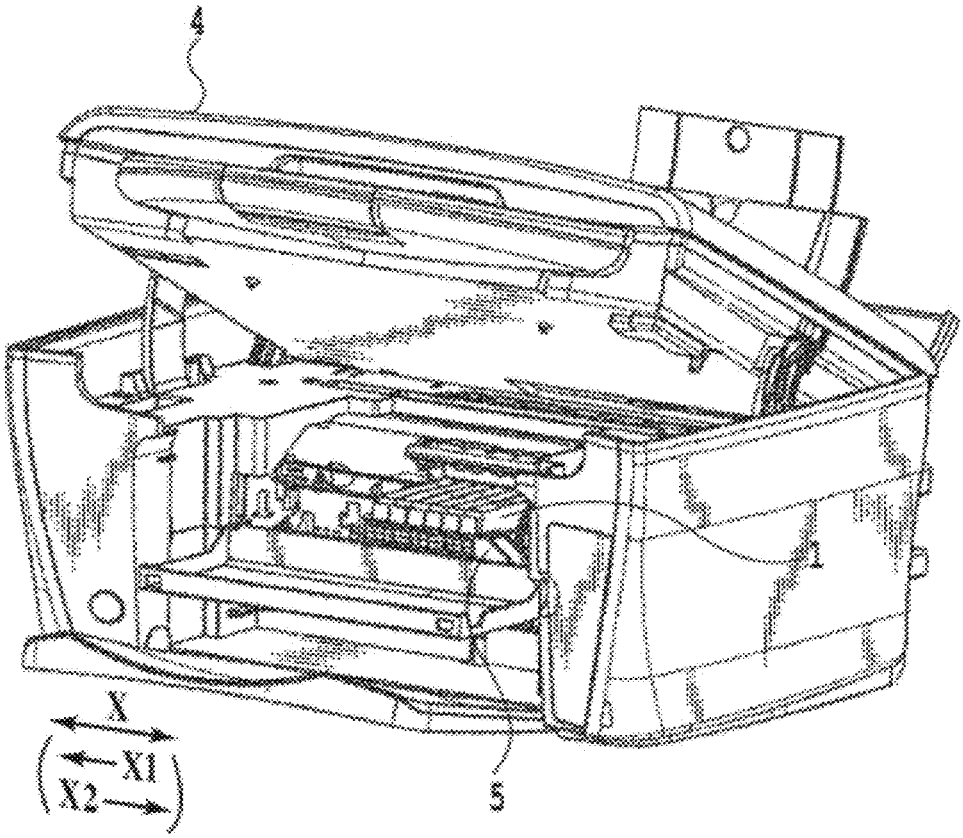
FIG. 3 is a perspective view of an ink jet printing apparatus to which the ink jet print head of this invention can be applied.

The printer of this example, as shown in FIG. 3, is a so-called multifunction printer that incorporates a scanner 4. FIG. 3 is a perspective view of the multifunction printer, with its upper cover opened.

This printer has a carriage 5 that reciprocates in a main scan direction of arrow X, on which is mounted a print head 1. The print head 1 ejects ink as it moves with the carriage 5 in the direction of arrow X crossing the ejection opening arrays L (in this example, in a direction perpendicular to the ejection opening arrays L) to print an image on paper (print medium). This operation is called a printing scan. The paper is supplied from a paper tray within the printer and fed in a subscan direction crossing the main scan direction of arrow X (in this example, in a direction perpendicular to the main scan direction). On the upper part of the printer is provided a scanner 4 designed to take in an image to be printed. The scanner 4 is integrally formed with the upper cover of the printer.

Next, the printing operation will be explained. Image data read by the scanner 4 is stored in a buffer of the scanner 4, which performs image processing on the buffered image data. The processed image data is sent to a print buffer, from which it is further fed to a print image processing portion. Then paper is supplied from the paper tray.

A print signal from one scan taken of the image is sent via wiring in the carriage 5 to the print head 1, which, based on the print signal, ejects ink as it moves forwards (in the direction of arrow X1) along with the carriage 5 (forward scan). This is followed by the paper being fed a distance of 128 dots of 600 dpi in the subscan direction. Then, the next print signal from another scan taken of the image is sent via the wiring of the carriage 5 to the print head 1, which, based on that print signal, ejects ink as it moves backwards (in the direction of arrow X2) along with the carriage 5 (backward scan). Each of the ejection opening arrays L has 256 ejection openings 22, 23 arrayed at intervals of 600 dpi. Of the 256 ejection openings, 128 ejection openings eject ink on the rasters that have been printed with ink dots in the preceding forward scan. Then, the paper is fed the distance of 128 dots of 600 dpi in the subscan direction.

By repeating such scans (forward scan and backward scan) and feeding the paper alternately, one page of paper is printed. In this embodiment, so-called, 2-pass printing is adopted, in which one raster is completed by two scans. Therefore, the print image processing portion uses a mask to divide print data for one and the same area into two scans.

(Printing a Gradation of Magenta)

Figure 4:
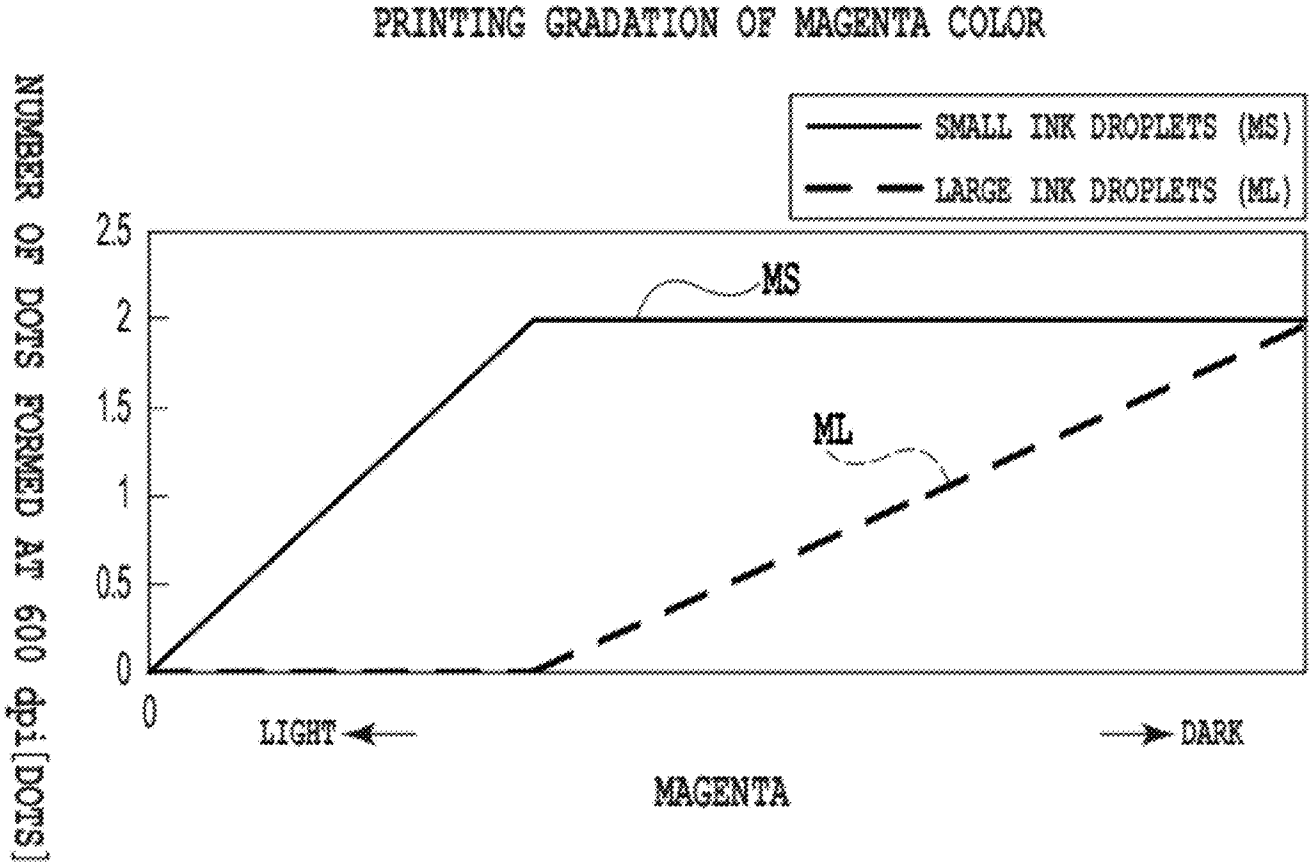
FIG. 4 is an explanatory diagram showing a method of printing a gradation of magenta in a first embodiment of this invention.

Next, by referring to FIG. 4, a method of printing a magenta gradation will be explained. The gradation is deemed to reach a sufficiently high grayscale level when two large dots of large ink droplets and two small dots of small ink droplets are formed at 600 dpi.

First, small ink droplets of magenta ink begin to be ejected and the ejection ratio of small magenta ink droplets (small dot formation percentage) in a unit print area is increased progressively as the grayscale level increases. Once the ejection ratio of small ink droplets has reached a predetermined level, large ink droplets of magenta ink are started to be ejected as the grayscale level rises. This is intended to alleviate graininess of the printed image. If only large magenta ink droplets land on the print surface, the large-diameter ink droplets show heavy graininess. However, landing small ink droplets first followed by large ink droplets makes the large ink dots less noticeable, mixed with small ink dots.

Then, as the grayscale level rises, the ejection ratio of large ink droplets (large dot formation percentage) is gradually increased. When the ejection ratio between the small ink droplets and the large ink droplets reaches 1:1, a sufficiently high grayscale level is reached.

In this example, the 2-pass printing method is employed. So, in an area where the gradation reaches the highest level of grayscale, two ejection opening array groups LG (M) eject large ink droplet to form one large dot and small ink droplet to form one small dot on average in each of the forward scan and the backward scan. The two ejection opening array groups LG (M) are formed with a large enough distance between them so that, during the magenta color printing, no air flow-based color variations occur at whatever printing grayscale level.

(Printing a Gradation that Changes from Yellow to Red)

Figure 5:
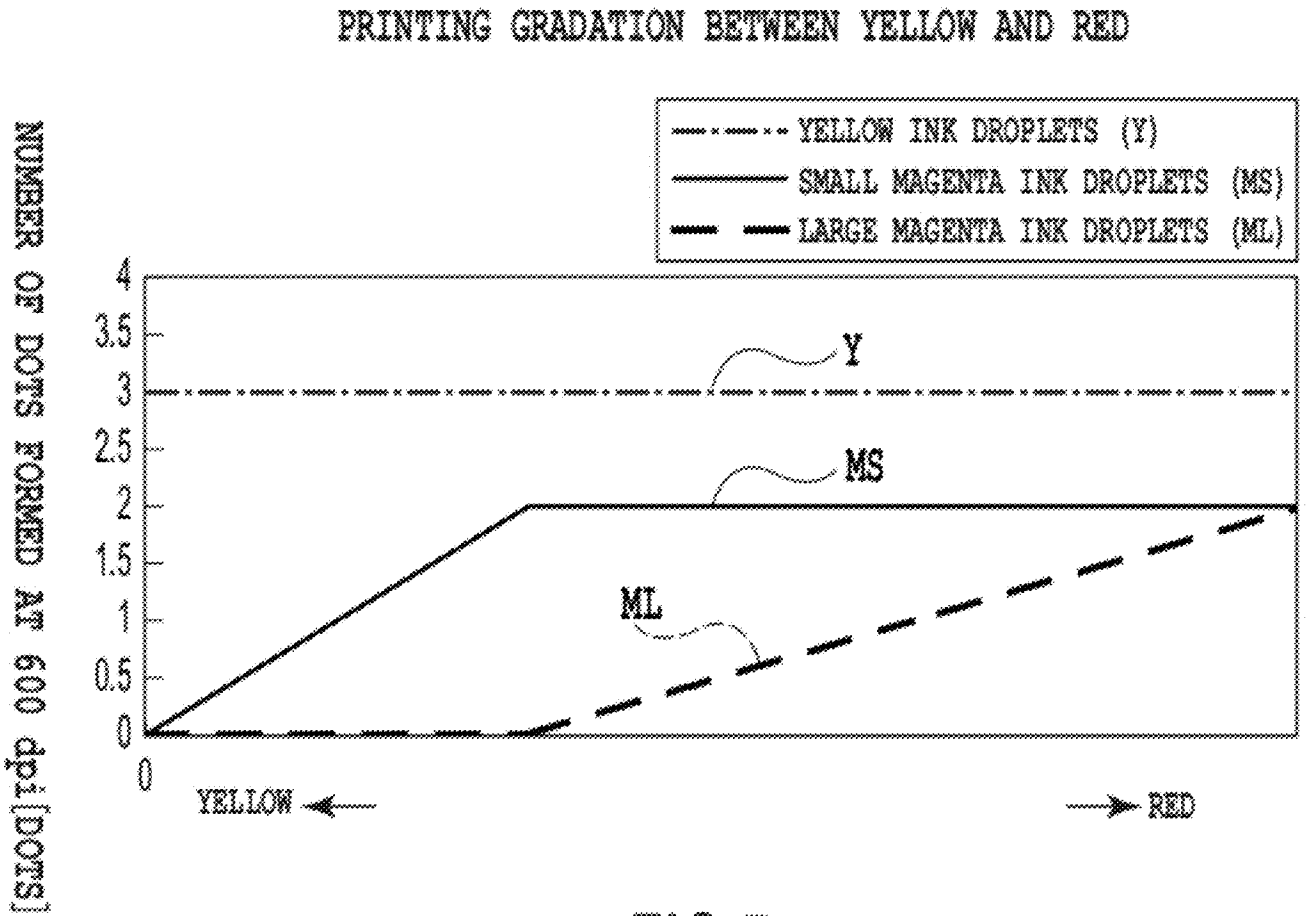
FIG. 5 is an explanatory diagram showing a method of printing a gradation between yellow and red in a first embodiment of this invention.

Next, by referring to FIG. 5, a method of printing a gradation that changes from yellow to red will be explained. It is assumed that yellow has had a sufficiently high grayscale level and that three dots of yellow ink have been formed at 600 dpi. A gradation of red is assumed to reach a sufficiently high grayscale level when two dots of large magenta ink droplets, two dots of small magenta ink droplets and three dots of large yellow ink droplets are formed at 600 dpi.

A gradation change is made from yellow to red as follows. Red is made by mixing yellow and magenta inks at a ratio of almost 1:1. So, yellow ink is ejected such that until yellow changes to red, three dots of yellow ink are formed in two scans at 600 dpi at all times.

When color changes from yellow to red, small magenta ink droplets are started to be ejected to progressively increase its ejection ratio (dot forming percentage). Then, once the small ink droplet ejection ratio has reached a predetermined level, large magenta ink droplets begin to be ejected. The ejection ratio of large magenta ink is gradually increased until the ejection ratio between the small magenta ink droplets and the large magenta ink droplets is 1:1, at which time the gradation becomes red at a sufficiently high grayscale level.

This example adopts the 2-pass printing method. So, in an area where the red color becomes darkest or has the highest grayscale level, two ejection opening array groups LG (M) eject large magenta ink droplet to form one large dot and small magenta ink droplet to form one small dot on average in each of the forward scan and the backward scan. In the area where the yellow color has the highest grayscale level, one ejection opening array group LG (Y) ejects large yellow ink droplets to form 1.5 dots on average in each of the forward scan and the backward scan. The ejection opening array groups LG (M) and the ejection opening array group LG (Y) do not adjoin and are spaced sufficiently part. Therefore, when the color changes from yellow to red during printing, no air flow-based color variations occur, regardless of the grayscale level of the printed image, assuring a high-quality printed image.

(Printing a Gradation that Changes from Cyan to Blue)

Figure 6:
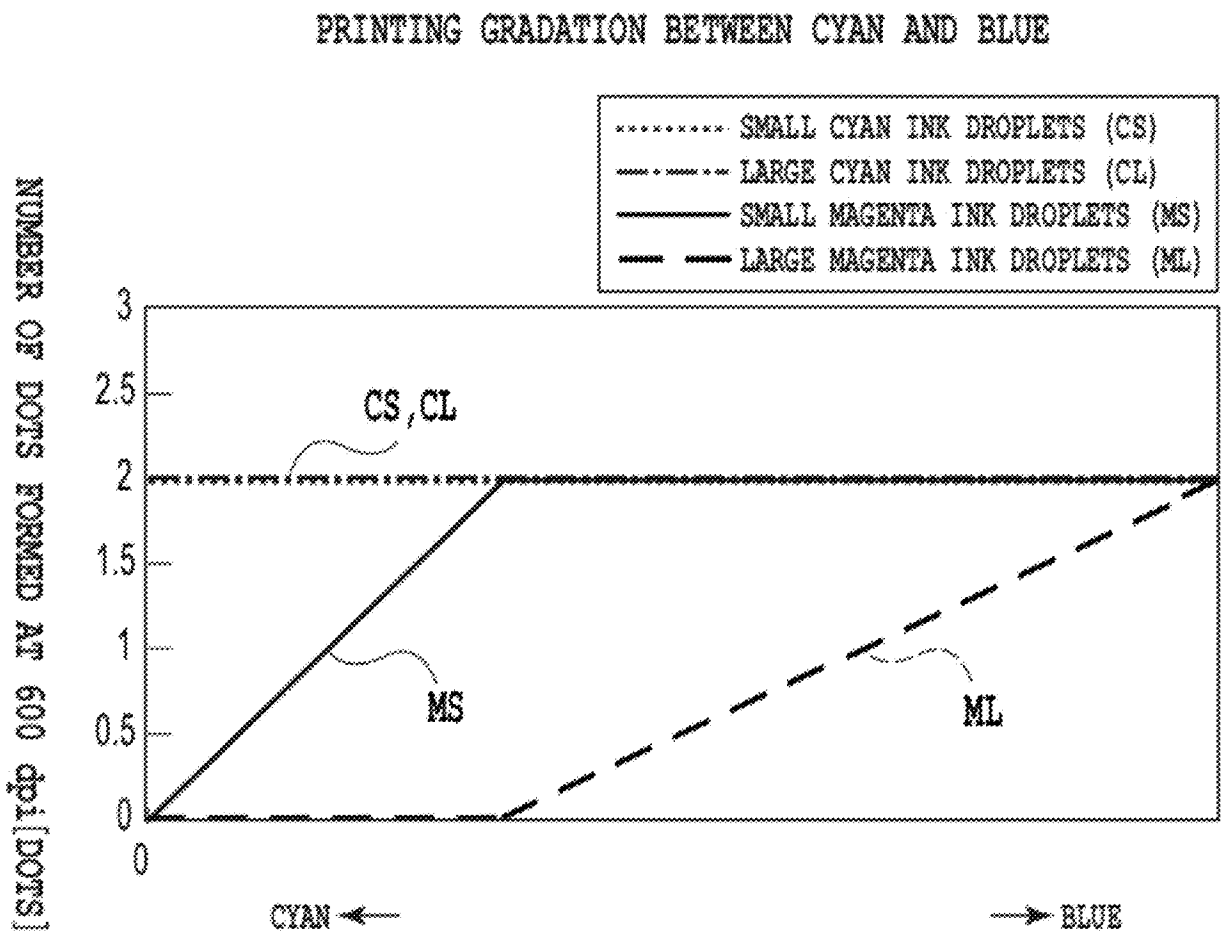
FIG. 6 is an explanatory diagram showing a method of printing a gradation between cyan and blue in a first embodiment of this invention.

Next, by referring to FIG. 6, a method of printing a gradation that changes from cyan to blue will be explained. It is assumed that cyan have had a sufficiently high grayscale level and that two large dots of cyan large ink droplets and two small dots of cyan small ink droplets have been formed at 600 dpi. A gradation of blue is assumed to reach a sufficiently high grayscale level when two dots of large magenta ink droplets, two dots of small magenta ink droplets, two dots of large cyan ink droplets and two dots of small cyan ink droplets are formed at 600 dpi.

A gradation changes from cyan to blue as follows. Blue is made by mixing cyan ink and magenta ink at a ratio of almost 1:1. So, cyan ink is ejected such that until cyan changes to blue, two large dots of cyan large ink droplets and two small dots of cyan small ink droplets are formed in two scans at 600 dpi at all times.

When the color changes from cyan to blue, the magenta small ink droplets begin to be ejected and its ejection ratio is progressively increased. Then when the ejection ratio of the magenta small ink droplets has reached a predetermined ratio, magenta large ink droplets begin to be ejected. After this, the ejection ratio of magenta large ink droplets is progressively increased until the ejection ratio of the magenta small ink droplets and magenta large ink droplets is 1:1, at which time the color becomes blue with a sufficiently high grayscale level.

This example adopts the 2-pass printing method. So, in an area where the blue color becomes darkest or has the highest grayscale level, two ejection opening array groups LG (M) eject large magenta ink droplet to form one large dot and small magenta ink droplet to form one small dot on average in each of the forward scan and the backward scan. In the area where the cyan color has the highest grayscale level, two ejection opening array groups LG (C) eject large cyan ink droplet to form one large dot and small cyan ink droplet to form one small dot on average in each of the forward scan and the backward scan. The ejection opening array group LG (M) for magenta ink and the ejection opening array group LG (C) for cyan ink adjoin each other at a small interval. However, each of the ejection opening array groups LG (M) and LG (C) forms on average 0.5 dot with large ink droplet and 0.5 dot with small ink droplet and their ink ejection densities are sufficiently small so that there is no disturbance in the landing position of small ink droplets of either cyan ink or magenta ink. Therefore, as the color changes from cyan to blue during printing, no air flow-based color variations occur, whatever grayscale level the image being printed has, assuring a high-quality printed image.

(Printing a Gradation that Changes from Yellow to Black)

Figure 7:
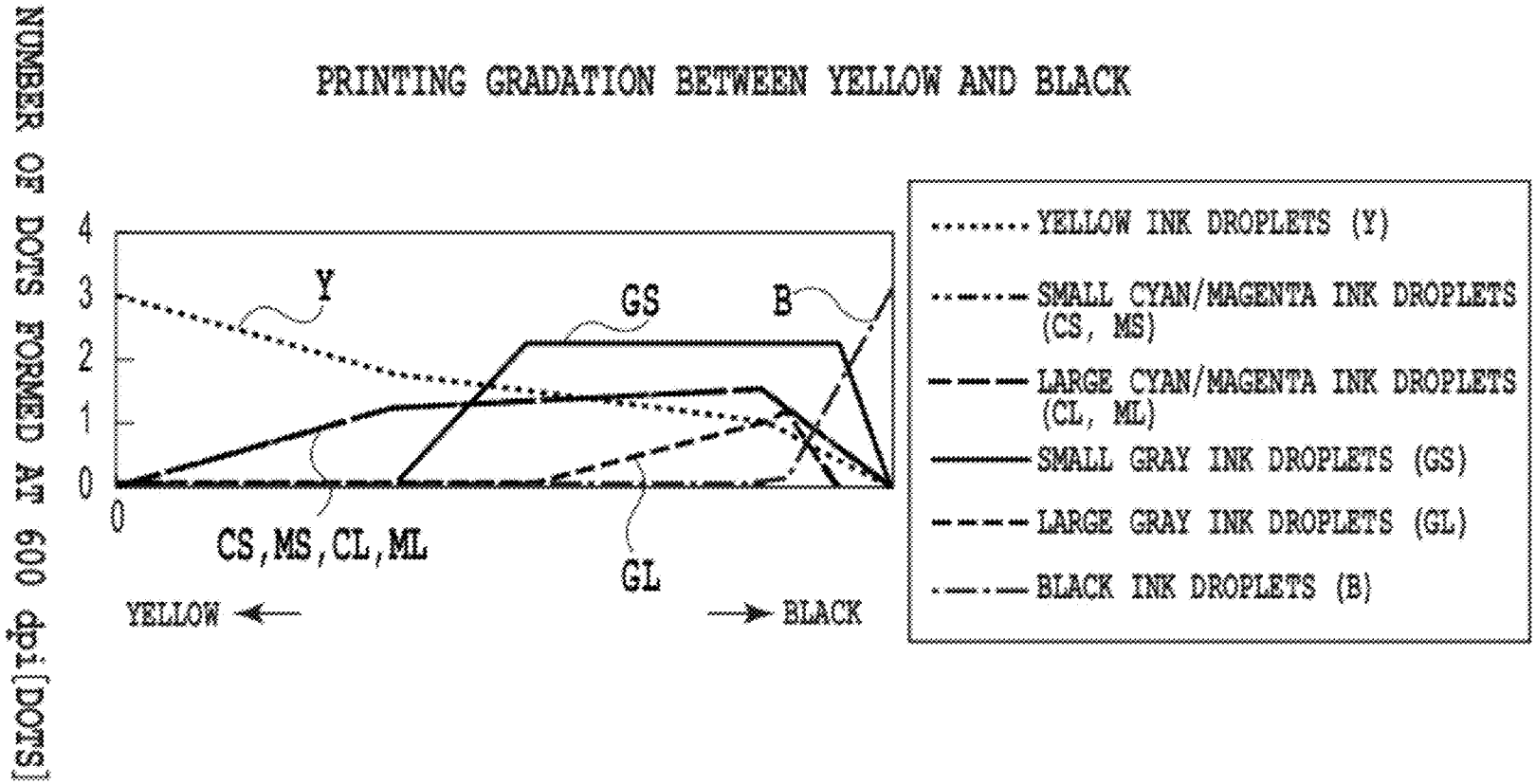
FIG. 7 is an explanatory diagram showing a method of printing a gradation between yellow and black in a first embodiment of this invention.

Next, by referring to FIG. 7, a method of printing a gradation that changes from yellow to black will be explained. It is assumed that the yellow color and the black color have sufficiently high grayscale level. The number of dots formed is as shown in FIG. 7.

A gradation is changed from yellow to black as follows. Black is a color made by mixing almost equal amounts of yellow ink, magenta ink and cyan ink. So, the yellow ink's ejection ratio is lowered progressively while the gradation changes from yellow to black. In a state in which only the yellow ink is ejected to form 3 dots in two scans at 600 dpi, small ink droplets of magenta and cyan inks begin to be ejected and their ejection ratio is slowly increased. Accordingly, the yellow ink's ejection ratio is progressively lowered. From when the yellow ink's ejection ratio has reached a predetermined level, where one dot of yellow ink is formed on average at 600 dpi, small ink droplets of gray ink begin to be ejected and the gray ink's ejection ratio is slowly increased.

The gray ink is made by mixing equal amounts of cyan ink, yellow ink and magenta ink and diluting the mixture to ¼.

Therefore, one dot of small gray ink droplet can be replaced with 0.25 dot of small magenta ink droplet, 0.25 dot of small cyan ink droplet and 0.125 dot of large yellow ink droplet. However, to get a black color the ejection ratios of magenta ink and cyan ink needs to be increased, so their ejection ratios both increase although the ejection ratios of magenta ink and cyan ink become more moderate as they are subtracted by the amount equal to what is replaced with gray ink.

As with the case of magenta ink in the aforementioned red color, from when the ejection ratio of the small gray ink droplets has reached a predetermined level, the ejection of gray ink shifts to the ejection of large gray ink droplets. In the mean time, the ejection ratio of yellow ink continues to decrease and the ejection ratios of magenta ink and cyan ink progressively increase.

From when the ejection ratio of large gray ink droplets has reached a predetermined level, a black ink begins to be ejected. Accordingly, the ejection ratios of yellow, magenta, cyan and gray ink are decreased. When the ejection ratio of black ink reaches a predetermined level, where 3 dots of black ink are formed in two scans at 600 dpi, the other ink ejections are stopped. This is when the color becomes black.

In this example, the 2-pass printing method is employed. So, in an area where the grayscale level of yellow is highest, the ejection opening array group LG (Y) ejects large yellow ink droplets to form 1.5 dots on average in each of the forward and backward scans. In an area where black is at the highest grayscale level, the black ink ejection opening array group LG (Bk) ejects large black ink droplets to form 1.5 dots on average in each of the forward and backward scans. When small gray ink droplets begin to be ejected, the yellow ink ejection opening array group LG (Y) adjoining the gray ink ejection opening array groups LG (G) ejects ink droplets to form one dot on average in each of the forward and backward scans. The magenta ink ejection opening array groups LG (M) eject small ink droplets to form 0.25 dot on average in each of the forward and backward scans. These ejection opening array groups LG (Y), LG (G), LG (M) adjoin each other at small intervals. However, as with the printing of blue color, since the ejection densities of ink droplets from these ejection opening array groups are sufficiently small, there are no disturbances in the landing positions of the ink droplets.

The distance between the black ink ejection opening array group LG (Bk) and the adjoining cyan ink ejection opening array group LG (C) is small. So, small cyan ink droplets are affected by the air flows as they land. However, since the black grayscale level is sufficiently high, the image quality is not impaired by the air flows. In this example, since the highest grayscale level of black color is accomplished by using only the black ink, small cyan ink droplets are affected by the air flows (air flow-based color variations). However, setting an ink parameter so that the highest grayscale level of black color is established by mixing cyan, magenta, yellow and gray ink with black ink, can prevent the small cyan ink droplets from being affected by air flows.

As described above, the image quality can be kept high even when printing a gradation that changes from yellow to black, regardless of the grayscale level of the printed image.

(Example for Comparison)

Figure 8:
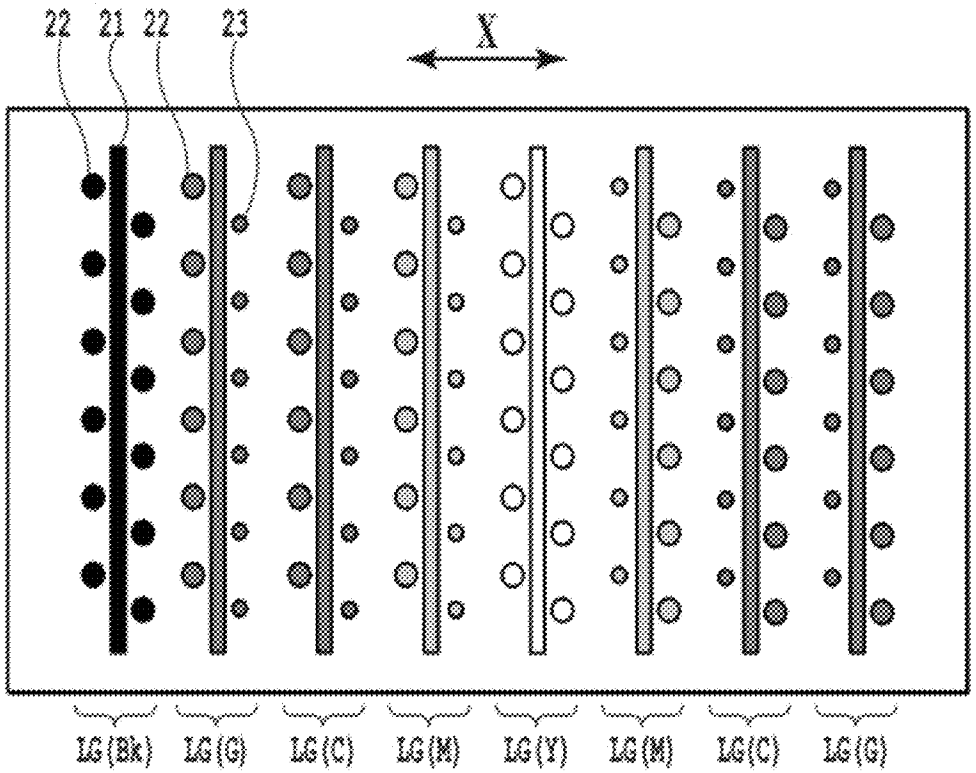
FIG. 8 is an explanatory diagram showing an example print head for comparison with the print head of the first embodiment of this invention.

Next, a print head for comparison will be explained which has ejection opening array groups LG arranged as shown in FIG. 8, in which there are, from left to right, black (Bk), gray (G), cyan (C), magenta (M), yellow (Y), magenta (M), cyan (C) and gray (G) ink ejection opening array groups.

Using this comparison print head, the process of printing a gradation that changes from yellow to red will be discussed.

While yellow ink is ejected to form 3 dots in 2 scans at 600 dpi, small magenta ink droplets begin to be ejected in much the same way as the preceding embodiment. In this comparison example, the yellow ink ejection opening array group LG (Y) and the two ejection opening array groups LG (M) adjoin with a small distance in between. So, the landing positions of small magenta ink droplets may be disturbed by the air flows produced by the yellow ink droplets as they are ejected. Therefore, during the printing of a gradation that changes from yellow to red, air flow-based color variations may occur degrading the image quality.

Next, using this comparison print head, the process of printing a gradation that changes from yellow to black will be discussed.

The color is changed from yellow to black as follows. In a state in which only yellow ink is being ejected to form 3 dots in 2 scans at 600 dpi, small gray ink droplets begin to be ejected and its ejection ratio is progressively increased. Then, as with the preceding embodiment, as the ejection ratio of gray ink is increased, the ejection ratio of yellow ink is lowered. When the ejection ratio of gray ink has reached a predetermined ratio, the black ink begins to be ejected.

In this comparison example, the yellow ink ejection opening array group LG (Y) and the gray ink ejection opening array groups LG (G) do not adjoin and their distances are long. The distance between the black ink ejection opening array group LG (Bk) and the adjoining gray ink ejection opening array group LG (G) is short. Under this condition, although the small gray ink droplets are disturbed by the air flows produced by the large black ink droplets, the image quality is not degraded because the grayscale level of black color has already become high enough. So, during the printing of the gradation that changes from yellow to black, the image quality remains good, whatever grayscale level the image being printed has.

(Comparison Between this Embodiment and Comparison Example)

In this embodiment since the image quality is good during the printing of both a yellow-to-red changing gradation and a yellow-to-black changing gradation, this embodiment is clearly advantageous.

Other means of avoiding the air flow-based color variations may include simply increasing the distance between the ejection opening arrays, lowering the ink ejection densities, slowing down the carriage travel speed and increasing the sizes of ink droplets ejected. However, simply increasing the distance between the ejection opening arrays also increases the size of the print head, resulting in an increase in the cost of the print head. Lowering the ejection densities or slowing the carriage travel speed can reduce the printing speed. Increasing the sizes of ink droplets can deteriorate the graininess of the printed image, degrading the image quality. Compared with these means for avoiding the air flow-based color variations, this embodiment has clear advantages.

Second Embodiment

In the above embodiment, the gray ink ejection opening array groups LG (G) are placed between the magenta ink ejection opening array groups LG (M) and the yellow ink ejection opening array group LG (Y). It is also possible to use the black ink ejection opening array groups LG (Bk) instead of the gray ink ejection opening array groups LG (G).

In that case, the black ink ejection opening array group LG (Bk) adjoining the cyan ink ejection opening array group LG (C) may be replaced with other ink ejection opening array group. Or, as shown in FIG. 9, the black ink ejection opening array group LG (Bk) adjoining the cyan ink ejection opening array group LG (C) may be eliminated to have only seven sets of common liquid chamber 21 and ejection opening array group LG.

Figure 9:
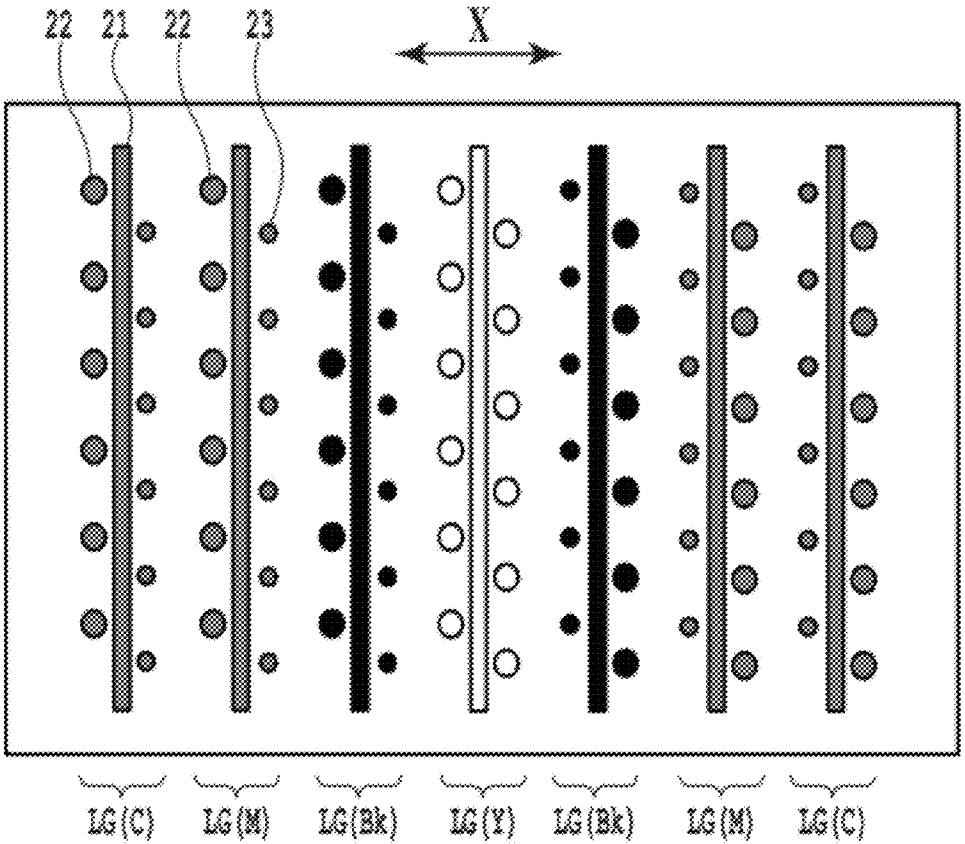
FIG. 9 is an explanatory diagram showing ejection opening arrays in a second embodiment of this invention.

Arranging two black ink ejection opening array groups LG (Bk) symmetrically, as shown in FIG. 9, enables large black ink droplets and small black ink droplets to be ejected, so that when forming an image on plain paper in a bidirectional printing, the large and small black ink droplets can be used. The use of the large and small black ink droplets improves the depth of gradation compared to when only the large black ink droplets are used.

When a gradation that changes from yellow to black is printed using the print head of FIG. 9, the timing at which to start ejecting the small black ink droplets is later than or closer to black than the timing in FIG. 7 at which small gray ink droplets are started to be ejected. In this case, too, the image quality is improved compared to when only cyan, magenta and yellow ink are used.

Third Embodiment

Figure 10:
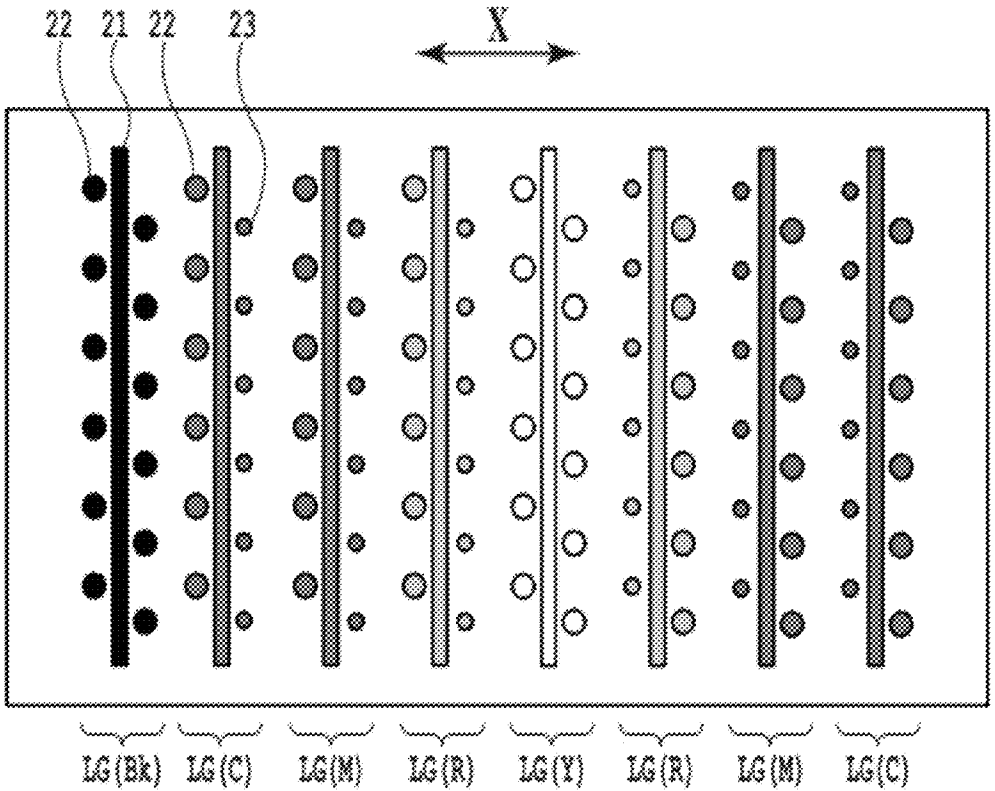
FIG. 10 is an explanatory diagram showing ejection opening arrays in a third embodiment of this invention.

It is also possible to put red ink ejection opening array groups LG (R) between the magenta ink ejection opening array groups LG (M) and the yellow ink ejection opening array group LG (Y), as shown in FIG. 10.

By making the red ink have a higher saturation than does a color created by a mixture of magenta ink and yellow ink, an image with a strong red color, such as one of a setting sun, can be printed with a sufficiently high saturation. This also applies to other inks than the red ink, such as green or blue ink. Making these inks also have higher saturations than do colors created by mixtures of two color inks can print images with these strong colors. In such an arrangement, too, when the yellow ink is used in large quantities, cyan ink and magenta ink may be used, rather than the red ink, green ink or blue ink, to prevent air flow-based color variations, thereby improving the image quality.

It is also possible to put light cyan ink ejection opening array groups between the magenta ink ejection opening array groups LG (M) and the yellow ink ejection opening array group LG (Y). The light cyan ink is an ink made by increasing the amount of a solvent component of the cyan ink to lower the grayscale level of cyan dye. The use of such a light cyan can smooth the gradation ranging from a highlighted portion of the cyan color to an intermediate portion. In this arrangement, too, when the yellow ink ejection density is high, the cyan ink may be used, rather than the light cyan ink, to prevent air flow-based color variations, thus improving the image quality. When a light magenta ink is used in place of the light cyan ink, the gradation ranging from a highlighted portion of the magenta color to an intermediate portion can be made smooth.

In this embodiment, the cyan ink ejection opening array groups LG (C) are situated outside the magenta ink ejection opening array groups LG (M) with respect to the yellow ink ejection opening array group LG (Y). It is also possible to replace the two cyan ink ejection opening array groups LG (C) with the two magenta ink ejection opening array groups LG (M).

Fourth Embodiment

In the preceding embodiments, two kinds of ejection openings 22, 23—large and small ejection openings—are provided for ejecting each of cyan, magenta and gray ink. The number of kinds of ejection openings is not limited to two.

Figure 11:
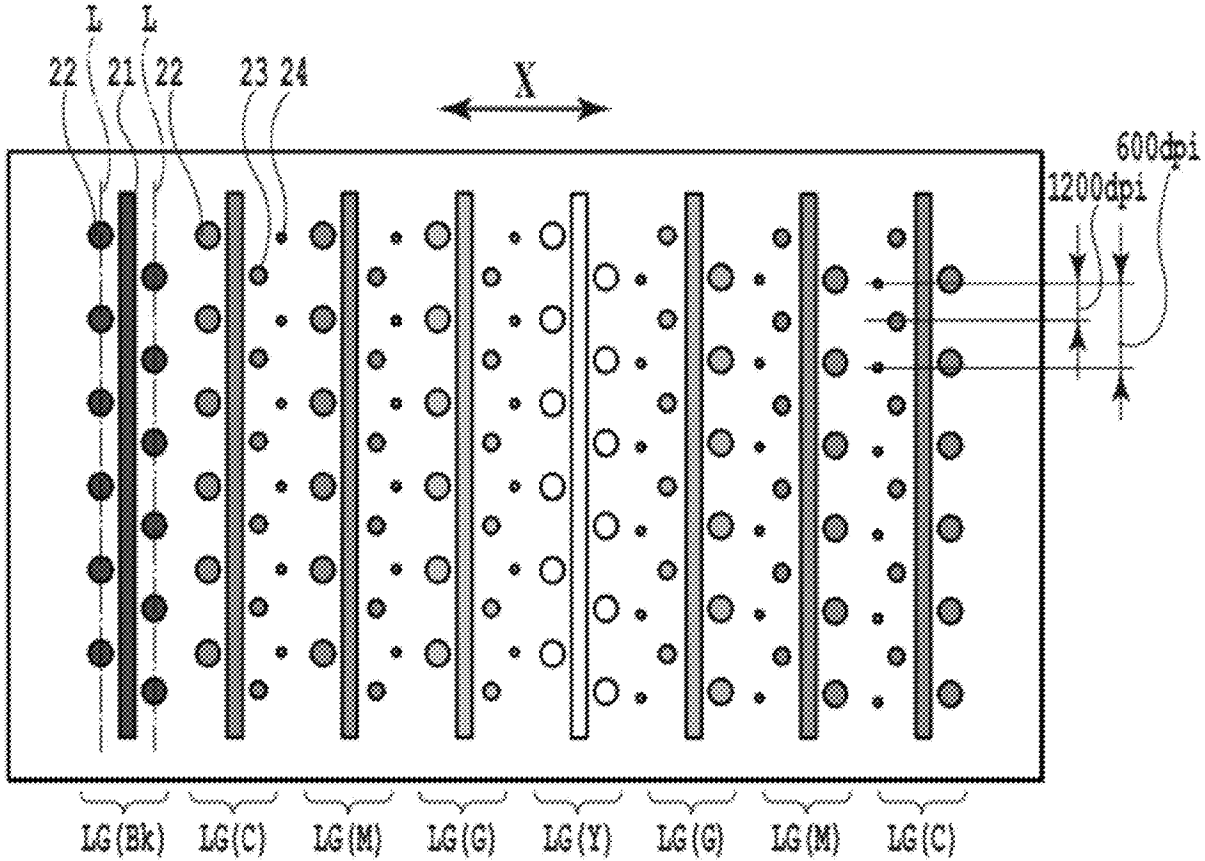
FIG. 11 is an explanatory diagram showing ejection opening arrays in a fourth embodiment of this invention.

For example, as shown in FIG. 11, three kinds of ejection openings 22, 23, 24 to eject three different sizes—large, medium and small—of ink droplets may be provided for each of cyan ink ejection opening array groups LG (C), magenta ink ejection opening array groups LG (M) and gray ink ejection opening array groups LG (G).

Figure 12B:
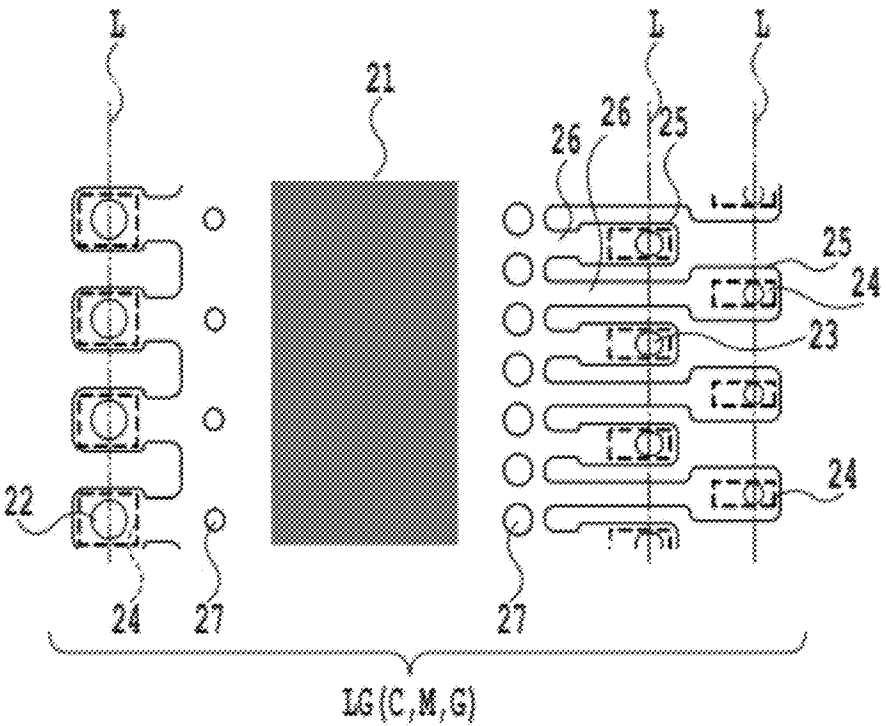
FIG. 12B is an outline configuration diagram showing cyan ink, magenta ink and gray ink ejection opening arrays of FIG. 11.

Each of these ejection opening array groups LG (C), LG (M), LG (G), as shown in FIG. 11 and FIG. 12B, has the ejection openings 23 and ejection openings 24 arrayed staggered at 1200-dpi intervals on that side of the associated common liquid chamber 21 which is near the yellow ink ejection opening array group LG (Y). The ejection openings 23 to eject the medium ink droplets are oval-shaped, about 10 μm in its short diameter and about 12 μm in a longer diameter. The ejection openings 24 to eject the small ink droplets are circular, about 9 μm across. The large ink droplets have a volume of about 5 pl, the medium ink droplets about 2 pl, and the small ink droplets about 1 pl.

Figure 12A:
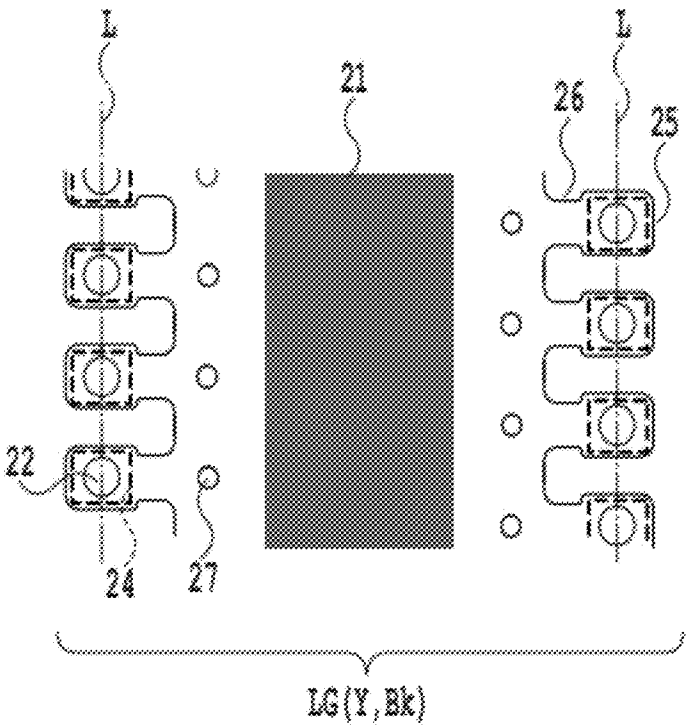
FIG. 12A is an outline configuration diagram showing black ink and yellow ink ejection opening arrays of FIG. 11

The yellow ink ejection opening array group LG (Y) and the black ink ejection opening array group LG (Bk) are formed in the same way as the preceding embodiments. That is, these ejection opening array groups, as shown in FIG. 11 and FIG. 12A, have their ejection openings 22, about 16 μm across, formed on the ejection opening arrays L, at 600-dpi intervals to eject large ink droplets.

Since the ejection opening array groups LG (C), LG (M), LG (G) each eject three sizes of ink droplets—large, medium and small—the gradation can be divided largely into three stages. That is, the first stage is one where only the small ink droplets are ejected. When the ejection ratio of the small ink droplets reaches a predetermined value, the medium ink droplets begin to be used, which is the second stage. The third stage is one where, when the ejection ratio of the medium ink droplets reaches a predetermined value, the large ink droplets begin to be used.

In this embodiment, too, a good image quality can be obtained, as in the preceding embodiments. When, for example, a gradation that changes from yellow to black is printed, the image quality can be improved by starting ejecting the gray ink only when the ejection density of the yellow ink has sufficiently lowered, as with the preceding embodiments.

This embodiment has the following advantages. That is, since there are three dot sizes, the grayscale representation is sufficiently smooth in frequently used grayscale ranges of individual color spaces. Another advantage is that a black color at high grayscale level can be printed. Still another advantage is that the size of the ink ejection portion 3 (see FIG. 16) can be made small by limiting the number of ejection opening array groups LG to eight by using a gray ink as a halftone ink.

Because of the provision of three dot sizes, when a light cyan ink and a light magenta ink are also used, the grayscale ranges in which they are used overlap the grayscale ranges of the normal cyan ink and the normal magenta ink. If only one kind of ink can be used as a halftone representation ink, the gray ink is given a priority. It is noted, however, that if there is no limitation on the size of the ink ejection portion 3, the image quality can be made better by the additional use of the light cyan ink and the light magenta ink.

Fifth Embodiment

Figure 13:
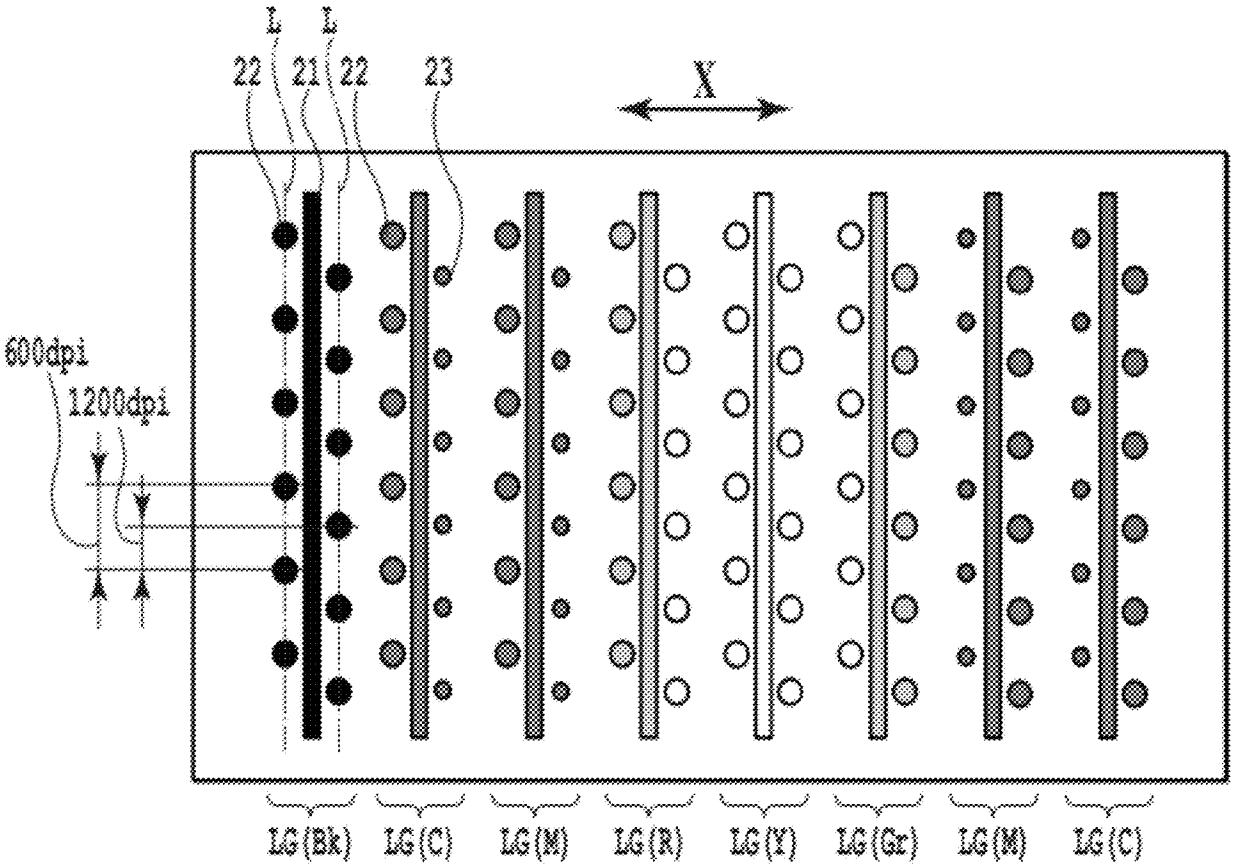
FIG. 13 is an explanatory diagram showing ejection opening arrays in a fifth embodiment of this invention.

FIG. 13 explains the construction of a print head according to the fifth embodiment of this invention. There are eight common liquid chambers 21 and also eight ejection opening array groups LG. To the eight common liquid chambers 21, from left to right in FIG. 13, are supplied black ink (Bk), cyan ink (C), magenta ink (M), red ink (R), yellow ink (Y), green ink (Gr), magenta ink (M) and cyan ink (C). For each of the black ink (Bk), yellow ink (Y), red ink (R) and green ink (Gr), one ejection opening array group LG is provide. For each of the cyan ink (C) and magenta ink (M), two ejection opening array groups LG are provided and arranged laterally symmetrical with respect to the yellow ink (Y) common liquid chamber 21, which is situated at the center.

In the ejection opening array groups LG (Bk), LG (Y), LG (P), LG (Gr) for black ink (Bk), yellow ink (Y), red ink (R) and green ink (Gr), the ejection openings 22 are arrayed at 600-dpi intervals on both sides of the associated common liquid chamber 21. The ejection openings 22 have a diameter of about 16 μm and eject large ink droplets of about 5 pl.

In the ejection opening array groups LG (C), LG (M) for cyan ink (C) and magenta ink (M), the ejection openings 22, about 16 μm in diameter, to eject large ink droplets of about 5 pl are formed on one side of the associated common liquid chamber 21 and the ejection openings 23, about 12 μm in diameter, to eject small ink droplets of about 2 pl are formed on the other side. More specifically, the ejection opening array groups LG (C), LG (M) have the ejection openings 22 formed at 600-dpi intervals on a side of the associated common liquid chamber 21 which is near the yellow ink ejection opening array group LG (Y) and, on the far side, the ejection openings 23 formed at 600-dpi intervals.

The red ink is made by selecting colorants more saturated than a mixture of magenta ink and yellow ink. Similarly, the green ink is prepared by selecting colorants more saturated than a mixture of cyan ink and yellow ink. The red ink and the green ink are used to allow for printing highly saturated colors, as when printing vivid color photos of, for instance, setting sun and grassy field.

(Printing a Gradation that Changes from Yellow to Red)

Next, by referring to FIG. 13, the method of printing a gradation that changes from yellow to red will be explained. It is assumed that the yellow had have a sufficiently high grayscale level and that three large dots of large yellow ink droplets are formed at 600-dpi. It is also assumed that the red color gradation reaches a sufficiently high grayscale level when three large dots of large red ink droplets are formed at 600-dpi. Although it is more saturated than its component colors, the red ink is made from the yellow ink and the magenta ink mixed at a ratio of almost 1:1. So, each time the number of large red ink dots increases by one, the yellow ink and the magenta ink reduce their ejection ratios by an equivalent of 0.5 large dot.

The gradation is made to change from yellow to red as follows.

Since this example employs the 2-pass printing method, the yellow color is produced by forming three large dots of large yellow ink droplets at 600-dpi in two scans. In this state, small magenta ink droplets begin to be ejected to progressively increase their ejection ratio. When the ejection ratio of small magenta ink droplets has reached a predetermined value, the large magenta ink droplets begin to be ejected. This is followed by the large red ink droplets being started to be ejected, with their ejection ratio being progressively increased. As the red ink starts to be used, the volumes of yellow ink and magenta ink used are progressively reduced. When three large dots of large red ink droplets are formed at 600-dpi, the red color reaches a sufficiently high grayscale level.

This example prints the gradation in two passes. So, in areas where the red color reaches the highest level of grayscale, one ejection opening array group LG (R) ejects large red ink droplets to form 1.5 large dots on average in each of the forward scan and the backward scan. When red ink droplets begin to be ejected, large yellow ink droplets are ejected to form 1.5 large dots on average in each scan. At this time, large magenta ink droplets are also ejected to form about 0.25 large dot and small magenta ink droplets ejected to form about 0.5 small dot.

Figure 14:
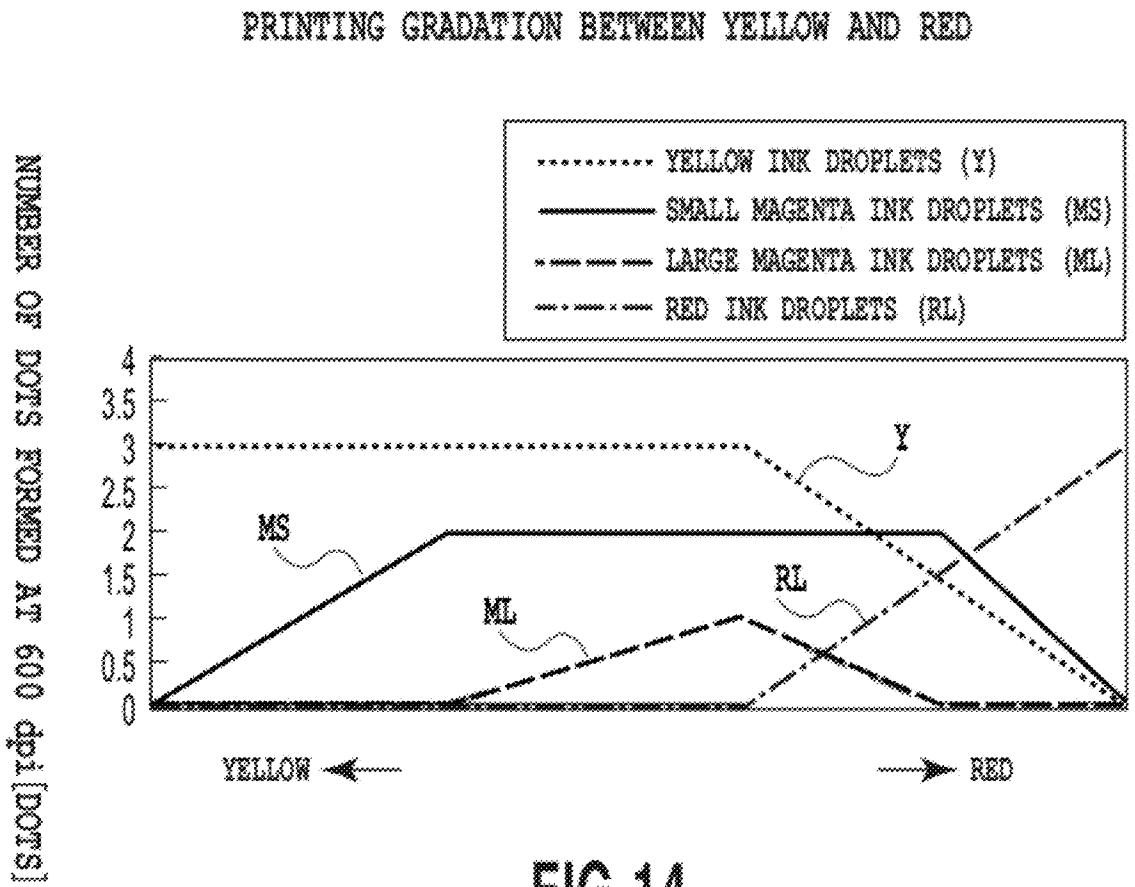
FIG. 14 is an explanatory diagram showing a method of printing a gradation between yellow and red in the fifth embodiment of this invention.

The magenta ink ejection opening array group LG (M) on the left side in FIG. 13, the red ink ejection opening array group LG (R) and the yellow ink ejection opening array group LG (Y) adjoin each other at small intervals. As shown in FIG. 14, while the ejection density of the magenta ink is low, the ejection density of the yellow ink is high.

However, since the red ink droplets are larger they are not affected by the air flow produced by the yellow ink ejection.

So, during the printing of a color that is changing from yellow to red, no air flow-based color variations occur, whatever grayscale level the image being printed has, assuring a high-quality printed image.

(Printing a Gradation that Changes from Yellow to Green)

When printing a gradation that changes from yellow to green, the same process occurs as when printing a gradation that changes from yellow to red, except that the magenta ink is replaced with the cyan ink.

In this case also, the green droplets are large and thus are not affected by the air flow produced by the yellow ink ejection. Therefore, also during the printing of a color that is changing from yellow to green, no air flow-based color variations occur, whatever grayscale level the image being printed has, assuring a high-quality printed image.

In this embodiment, the red ink ejection opening array group LG (R) and the green ink ejection opening array group LG (Gr) are interposed between the magenta ink ejection opening array groups LG (M) and the yellow ink ejection opening array group LG (Y). However, one of the ejection opening array groups LG (R), LG (Gr) may be an ink ejection opening array group LG for a blue ink with high level of saturation. In this case, too, the gradation that changes from yellow to blue can be printed with a similar effect to that of the printing of a gradation that changes from yellow to red or to green.

In place of the red ink and the green ink, a gray ink and a light gray ink may be used. In that case, an effect of smoothing the gradation in monochrome printing can be produced in addition to assuring a good print quality of red color.

Further, in place of the red ink and the green ink, a light cyan ink and a light magenta ink may be used. In that case, the gradations of halftone of cyan and magenta can be made smooth in addition to assuring a good print quality of red color.

The diameter of the ejection openings 22 for red ink and green ink may be set to 12 μm rather than 16 μm. This makes smooth the gradation in the red or green color space near magenta or cyan.

It is also possible to provide between the magenta and yellow ink ejection opening array groups LG (M), LG (Y) an ejection opening array group LG that ejects an ink of light color or saturated color made of one or more of cyan, magenta and yellow ink. In that case, the gradation of halftone can be made deep or smooth or a highly saturated color printed, which in turn prevents the air flow-based color variations even if the yellow ink ejection density is high, assuring a high quality of printed images.

Other Embodiments

Although the preceding embodiments have been described to eject ink by using a pressure of bubble in ink produced by a heater, the heater may be replaced with a piezoelectric element.

While in the preceding embodiments the ejection opening array groups LG have been described to have two or three ejection opening arrays L, they may be constructed to have only one ejection opening array L. In such a case, too, the air flow-based color variations can be prevented.

Figure 15:
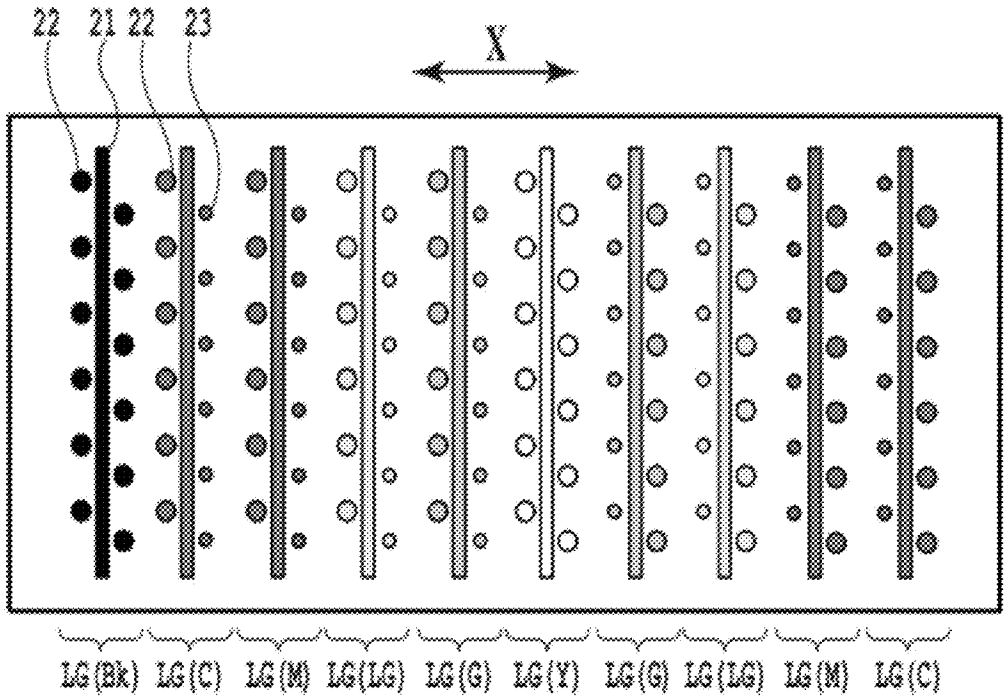
FIG. 15 is an explanatory diagram showing ejection opening arrays in another embodiment of this invention.

In either of the preceding embodiments, one ejection opening array group is arranged between the yellow ink ejection opening array group LG (Y) and the magenta ink ejection opening array groups LG (M). It is also possible to arrange two or more ejection opening array groups between the ejection opening array groups LG (Y) and LG (M), as shown in FIG. 15. In FIG. 15, LG (G) represents gray ink ejection opening array group and LG (LG) represents light gray ink ejection opening array group.

The ink jet print head of this invention needs only to include ejection openings for yellow, magenta and cyan inks and an ejection opening for a fourth ink other than yellow, magenta and cyan. A plurality of ejection openings for ejecting one of yellow, magenta and cyan ink are lined along at least one of a first ejection opening array, a plurality of ejection openings for ejecting one of the remaining two inks are lined along at least one of a second ejection opening array, and a plurality of ejection openings for ejecting the remaining ink are lined along at least one of a third ejection opening array. The first, second and third ejection opening array are arranged parallelly to adjoin each other in a predetermined direction, with the number of the first ejection opening arrays being less than those of the second and third ejection opening arrays. A plurality of ejection openings to eject the fourth ink are arranged along a fourth ejection opening array between the first ejection opening arrays and the second or third ejection opening arrays, that are arranged to adjoin each other in the predetermined direction.

The first, second third and fourth ejection opening arrays may be placed on both sides, with respect to the predetermined direction, of the associated common liquid chamber, to which ink is supplied, to form the first, second, third and fourth ejection opening array groups. In that case, the number of first ejection opening array groups is smaller than those of the second ejection opening array groups and the third ejection opening array groups. The fourth ejection opening array group is disposed between the first ejection opening array groups and the second or third ejection opening array groups, which adjoin each other in the predetermined direction. Further, on the outer side of the third ejection opening array groups may be arranged a fifth ejection opening array group for ejecting a fifth ink, which is different from yellow, magenta, cyan and fourth inks.

By using the ink jet print head having the first, second, third and fourth ejection opening arrays formed parallelly to adjoin each other in the predetermined direction, an image can be printed on a print medium. Each of the first, second, third and fourth ejection opening array has a plurality of ink ejection openings arrayed, with the number of the first ejection opening arrays being less than those of the second ejection opening arrays and the third ejection opening arrays. The fourth ejection opening arrays are disposed between the first ejection opening arrays and the second or third ejection opening arrays, which are arranged adjoining each other in the predetermined direction. Printing an image by using such a print head involves ejecting one of the yellow, magenta and cyan inks from the first ejection opening arrays, ejecting one of the remaining two inks from the second ejection opening arrays, ejecting the remaining ink from the third ejection opening arrays, and then ejecting the fourth ink, different from the yellow, magenta and cyan ink, from the fourth ejection opening arrays.

The present invention is not limited to the serial type, bidirectional printing apparatus but can also be applied to a unidirectional printing apparatus that prints an image in only a forward or backward scan. Further, this invention is also applicable to a so-called full-line type printing apparatus, which prints an image continuously with a long print head extending widthwise of the print medium over an entire width of the print area, by continuously moving the print head and the print medium relative to each other in one direction.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2008-213028, filed Aug. 21, 2008, which is hereby incorporated by reference herein in its entirety.

What is claimed is:

1. An ink jet print head having a plurality of ejection opening arrays which are parallelly arranged in a predetermined direction, the ink jet print head comprising:

a yellow ink ejection opening array in which a plurality of ejection openings for ejecting yellow ink are arranged;

first and second magenta ink ejection opening arrays in which a plurality of ejection openings for ejecting magenta ink are arranged;

first and second cyan ink ejection opening arrays in which a plurality of ejection openings for ejecting cyan ink are arranged;

first and second gray ink ejection opening arrays in which a plurality of ejection openings for ejecting gray ink are arranged; and a black ink ejection opening array in which a plurality of ejection openings for ejecting black ink are arranged, wherein the first gray ink ejection opening array is arranged on one side and the second gray ink ejection opening array is arranged on the other side of the yellow ink ejection opening array, with respect to the predetermined direction, wherein a first opening array set including the first magenta ink ejection opening array and the first cyan ink ejection opening array is arranged on one side of the first gray ink ejection opening array, and a second opening array set including the second magenta ink ejection opening array and the second cyan ink ejection opening array is arranged on the other side of the second gray ink ejection opening array, and wherein the black ink ejection opening array is arranged on one side of the first opening array set and/or is arranged on the other side of the second opening array set.

2. The ink jet print head according to claim 1, wherein the yellow ink ejection opening array, the first and second magenta ink ejection opening arrays, the first and second cyan ink ejection opening arrays, the first and second gray ink ejection opening arrays, and the black ink ejection opening array are each disposed on at least one of two sides, with respect to the predetermined direction, of an associated common liquid chamber to which ink is supplied.

3. The ink jet print head according to claim 2, wherein the yellow ink ejection opening array, the first and second magenta ink ejection opening arrays, the first and second cyan ink ejection opening arrays, the first and second gray ink ejection opening arrays, and the black ink ejection opening array are each disposed on both sides, with respect to the predetermined direction, of the associated common liquid chamber to form first, second, third, fourth, and fifth ejection opening array groups, wherein a number of yellow array groups is less than that of magenta or cyan array groups, wherein each gray array group is disposed between the yellow array group and a magenta or cyan array group, and the yellow array group and the gray array groups are adjacently arranged in the predetermined direction.

4. The ink jet print head according to claim 3, wherein the number of the yellow array groups is one and the number of the magenta and the cyan array groups is each two, wherein the two magenta array groups are arranged to be symmetrical in the predetermined direction with respect to the yellow array group as a center, and wherein the two cyan array groups are arranged to be symmetrical in the predetermined direction with respect to the yellow array group as a center and disposed outside the two magenta array groups.

5. The ink jet print head according to claim 4, wherein two of the gray array groups are provided, each between the yellow array group and one of the two magenta array groups.

6. The ink jet print head according to claim 1, wherein the gray ink is made by mixing two or more of the yellow ink, the magenta ink and the cyan ink.

7. The ink jet print head according to claim 1, wherein the gray ink comprises gray inks with different grayscale levels.

8. An ink jet printing apparatus for printing an image on a print medium by using an ink jet print head, wherein the ink jet print head has a first ejection opening array, second ejection opening arrays, third ejection opening arrays, fourth ejection opening arrays, and a fifth ejection opening array arranged parallelly and adjacently in a predetermined direction, each of the ejection opening arrays having a plurality of ink ejection openings, wherein the fourth ejection opening arrays are arranged on one side and the other side of the first ejection opening array, with respect to the predetermined direction, wherein a first opening array set of one of the second ejection opening arrays and one of the third ejection opening arrays is arranged on one side of the fourth ejection opening array arranged on the one side of the first ejection opening array, and a second opening array set of another of the second ejection opening arrays and another of the third ejection opening arrays is arranged on the other side of the fourth ejection opening array arranged on the other side of the first ejection opening array, wherein the fifth ejection opening array is arranged on one side of the first opening array set and/or is arranged on the other side of the second opening array set, and wherein the ink jet printing apparatus comprises a unit configured to cause the first ejection opening array to eject yellow ink, the second ejection opening arrays to eject magenta ink, the third ejection opening arrays to eject cyan ink, the fourth ejection opening arrays to eject gray ink, and the fifth ejection opening array to eject black ink.

9. An ink jet printing method for printing an image on a print medium by using an ink jet print head, the method comprising:

a providing step of providing the ink jet print head that has a first ejection opening array, second ejection opening arrays, third ejection opening arrays, fourth ejection opening arrays, and a fifth ejection opening array arranged parallelly and adjacently in a predetermined direction, each of the ejection opening arrays having a plurality of ink ejection openings, the fourth ejection opening arrays being arranged on one side and the other side of the first ejection opening array, with respect to the predetermined direction, a first opening array set of one of the second ejection opening arrays and one of the third ejection opening arrays being arranged on the one side of the fourth ejection opening array arranged on the one side of the first ejection opening array, and a second opening array set of another of the second ejection opening arrays and another of the third ejection opening arrays being arranged on the other side of the fourth ejection opening array arranged on the other side of the first ejection opening array, the fifth ejection opening array being arranged on one side of the first opening array set and/or being arranged on the other side of the second opening array set; and an ejecting step in which yellow, magenta, cyan, gray, and black inks are ejected from the first ejection opening array, the second ejection opening arrays, the third ejection opening arrays, the fourth ejection opening arrays, and the fifth ejection opening array, respectively.

10. An ink jet print head comprising:

a yellow ink ejection opening array formed by arranging, in a first direction, a plurality of ejection openings for ejecting yellow ink;

first and second colored ink ejection opening arrays along which are arranged a plurality of ejection openings for ejecting ink of a color other than yellow, magenta and cyan, the first colored ink ejection opening array being arranged on one side of the yellow ink ejection opening array, with respect to a second direction crossing the first direction, the second colored ink ejection opening array being arranged on the other side of the yellow ink ejection opening array, with respect to the second direction;

a first magenta ink ejection opening array and a first cyan ink ejection opening array which are arranged on a side of the first colored ink ejection opening array, with respect to the second direction, opposite to the yellow ink ejection opening array, a plurality of ejection openings for ejecting magenta ink being arranged along the first magenta ink ejection opening array, and a plurality of ejection openings for ejecting cyan ink being arranged along the first cyan ink ejection opening array; and a second magenta ink ejection opening array and a second cyan ink ejection opening array which are arranged on side of the second colored ink ejection opening array, with respect to the second direction, opposite to the yellow ink ejection opening array, a plurality of ejection openings for ejecting magenta ink being arranged along the second magenta ink ejection opening array, and a plurality of ejection openings for ejecting cyan ink being arranged along the second cyan ink ejection opening array.

11. The ink jet print head according to claim 10, wherein the ink ejected from the plurality of ejecting openings of the first and second colored ink ejection opening arrays is gray ink.

* * * * *